United States Patent [19]

Weinerman et al.

[11] Patent Number: 4,703,961

[45] Date of Patent: Nov. 3, 1987

[54] ROTARY LATCH WITH INTERNAL BUMPER BLOCK

[75] Inventors: Lee S. Weinerman, Medina; Joel T. Vargus, Middleburg Hts., both of Ohio

[73] Assignee: The Eastern Company, Strongsville, Ohio

[21] Appl. No.: 906,799

[22] Filed: Sep. 12, 1986

[51] Int. Cl.[4] ..... E05C 3/16

[52] U.S. Cl. ..... 292/216; 292/48

[58] Field of Search ..... 292/216, 280, 48, 78, 292/DIG. 49

[56] References Cited

U.S. PATENT DOCUMENTS

| | | | |
|---|---|---|---|
| 4,172,768 | 10/1979 | Cerdan | 292/216 |
| 4,177,656 | 12/1979 | Davis | 70/84 |
| 4,202,571 | 5/1980 | Nishikoori | 292/216 |
| 4,312,203 | 1/1982 | Davis | 70/472 |
| 4,320,642 | 3/1982 | Pastva, Jr. | 70/472 |
| 4,457,146 | 7/1984 | Weinerman | 70/100 |
| 4,569,544 | 2/1986 | Escarovage | 292/216 |

OTHER PUBLICATIONS

Eberhard Mfg. Co., Catalog No. 102, entitled "Handbook of Latches, Locks, Hinges, Handles and Related Hardware", 1983, pp. 67–68.

*Primary Examiner*—Richard E. Moore

*Attorney, Agent, or Firm*—David A. Burge

[57] ABSTRACT

A rotary latch has a U-shaped housing that is formed as a metal stamping having a base wall that connects spaced, parallel-extending side walls. A pair of opposed jaw members are housed between the side walls, are mounted for rotation betwen latched and unlatched positions, and are arranged to embrace and latchingly retain a striker as the striker is moved into a pair of aligned notches that are defined by the side walls. A "primary" one of the jaws is biased toward its unlatched position by a housing-carried spring. A "secondary" one of the jaws is arranged to engage a resilient bumper that cushions the action of the latch as the jaws rotate to their latched positions. When the jaws are latched, the primary jaw can be rotated in opposition to the action of the spring to a release position to initiate unlatching of the latch. The jaw members have cooperative formations that interact to coordinate the latching and unlatching movements of the jaw members, to prevent the jaw members from rotating beyond a predetermined range of movement during the latching process, and to prevent unlatching rotation of the jaw members until a releasing movement of the primary jaw member has been effected. The bumper is a trapezoidal shaped block of resilient material that is mounted on the housing by extending an elongate projecting portion of the bumper through a hole that is formed in the base wall of the housing. The bumper not only cushions the operation of the latch but also cooperates with the spring to bias the jaw members toward their unlatched positions and to prevent vibratory rattling of the relatively movable parts of the latch.

26 Claims, 12 Drawing Figures

ROTARY LATCH WITH INTERNAL BUMPER BLOCK

BACKGROUND OF THE INVENTION

1. Field of the Invention

The present invention relates generally to a rotary latch for receiving a striker that is movable relative to the latch, and for releasably retaining the striker to selectively arrest relative movement between the striker and the latch. More specifically, the present invention relates to a rotary latch of the type having a U-shaped housing with spaced, overlying side walls that define a pair of aligned notches for receiving a relatively movable striker, with a pair of rotary jaw members being carried between the side walls and being connected to the housing for rotation about axes that are located on opposite sides of the notches for releasably retaining a striker in the notches, and with a resilient bumper block being carried by the housing for cushioning the latching action as the jaw members rotate to a latched position wherein the striker is embraced to releasably retain the striker within the notches of the housing.

2. Prior Art

Rotary latch mechanisms of a wide variety of types and configurations have been proposed for such uses as retaining closures of various forms in closed positions.

A number of rotary latch proposals call for the use of a pair of opposed, rotary jaw members that are designed to embrace and releasably retain a striker to hold a closure closed. Other rotary latch proposals employ a pair of jaw members that receive a striker, but with only one of the jaws being rotatable to grasp a striker. Still other rotary latch proposals employ a single rotary jaw that receives a striker and pivots between latched and unlatched positions to selectively retain and release the striker.

One form of rotary latch mechanism that employs a pair of opposed rotary jaw members for engaging a striker, and that has enjoyed good commercial acceptance, is sold by Eberhard Manufacturing Company Division of The Eastern Company, Cleveland, Ohio 44136 under the model designations 400 R and 400 L. This form of latch is a relatively heavy duty unit that includes a riveted housing assembly formed from metal stampings, with the assembled housing being of generally U-shaped configuration and having a base wall that extends between a pair of spaced, parallel-extending side walls. Three rivets interconnect the side walls at spaced locations. Each of the rivets journals a separate one of three relatively rotatable operating elements that are housed between the side walls, namely a pair of rotary jaw members and a rotary pawl member. A separate torsion spring coil extends about each of the rivets, with each of the spring coils having a projecting spring arm that biases its associated operating element in a desired direction of rotation relative to the housing assembly. A pair of aligned notches are formed in the side walls of the housing assembly to receive a striker. The rotary jaw members have recess formations that face toward the notches for receiving and embracing a striker as the striker moves into the notches, with the rotary jaw members being configured to rotate concurrently about their respective axes as the striker is moved into the notches so as to latchingly engage the striker. As the striker moves progressively farther into the notches, the pawl engages one of the rotary jaw members in a progressive ratcheting type of action that prevents unlatching rotation of the rotary jaw members. Release of the latch is effected by rotating the pawl to a release position Another form of relatively heavy duty rotary latch that has enjoyed good commercial acceptance is depicted in FIGS. 14–24 of U.S. Pat. No. 4,320,642 issued Mar. 23, 1982 to John V. Pastva, Jr. and assigned to The Eastern Company. However, the principal elements of the rotary latch of the Pastva patent (see FIGS. 21–24 thereof) include only one rotatable jaw, together with one non-rotatable jaw and a rotatable pawl. The pawl and the jaws are mounted in a riveted housing assembly much like that which is utilized in the above-described model 400 R and 400 L products of Eberhard.

Still other forms of rotary latches of relatively large and relatively small size that have enjoyed good commercial acceptance are disclosed in U.S. Pat. Nos. 4,457,146 and 4,177,656 issued July 3, 1984 and Dec. 11, 1979, respectively, to Lee S. Weinerman and Edwin W. Davis, respectively, and assigned to The Eastern Company. Each of these patents discloses a rotary latch that employs a single rotary jaw or bolt that rotates to receive and releasably retain a striker.

As will be readily understood by those skilled in the art, many of the various forms of rotary latches that embody prior proposals are intended for use in relatively specialized applications, i.e., where there are specific needs for latches that can withstand particular types and magnitudes of loading, that will conform to certain limits of space availability, that conform to other special dimensional requirements, and/or that are designed to withstand certain specific types of wear and abuse. Many of the specialty rotary latches that have been proposed to date are designed for use with specially configured strikers that aid the latches in establishing securely latched connections that will hold associated closures closed in the presence of severe vibration, operational abuse, tampering and the like.

Despite a proliferation of rotary latch proposals, there remains a need for a simple and inexpensive rotary latch that is usable in a wide variety of light-duty latching applications, that occupies a minimum of space, that incorporates a minimal number of operating components, that can be used with any of a wide variety of simply-configured strikers, that can be operated (i.e., "unlatched") using any of a wide variety of connecting linkages, rods, cables or the like, and/or that can be operated simply by fingertip engagement with an actuating lever.

SUMMARY OF THE INVENTION

The present invention addresses the foregoing and other needs, and overcomes drawbacks of prior proposals by providing a novel, improved and highly versatile rotary latch for releasably retaining any of a wide variety of simply configured strikers to releasably latch a closure in its closed position. More specifically, the present invention relates to a rotary latch of the type having a housing with spaced, overlying side walls that define a pair of aligned notches for receiving a striker, with a pair of rotary jaw members being connected to the housing for rotation about axes that are located on opposite sides of the notches for releasably retaining a striker in the notches, and with a resilient bumper block being carried by the housing for cushioning the latching action as the jaw members rotate to a latching position wherein the striker is embraced to releasably retain the striker within the notches of the housing.

In accordance with the preferred practice of the present invention, a rotary latch has a U-shaped housing that is formed as a metal stamping having a base wall that connects spaced, parallel-extending side walls. A pair of opposed jaw members are housed between the side walls, are mounted for rotation between latched and unlatched positions, and are arranged to embrace and latchingly retain a striker as the striker is moved into a pair of aligned notches that are defined by the side walls. A "primary" one of the jaws is biased toward its unlatched position by a housing-carried spring. A "secondary" one of the jaws is arranged to engage a resilient bumper that cushions the action of the latch as the jaws rotate to their latched positions. When the jaws are latched, the primary jaw can be rotated in opposition to the action of the spring to a release position to initiate unlatching of the latch.

The jaw members have cooperative formations that interact (1) to effect concurrent latching and unlatching movements of the jaw members, (2) to prevent the jaw members from rotating beyond a predetermined range of movement during the latching process, and (3) to prevent unlatching rotation of the jaw members until a releasing movement of the primary jaw member has been effected. The cooperative formations preferably include (1) receiving formations that face toward the notches for engaging opposite side portions of the striker as the striker moves into the notches, (2) latching formations that engage to block unlatching rotation of the jaws once the jaws have reached their latched positions, and (3) stop formations that abut if rotation of the jaws in latching directions exceeds a desired range of movement. As the rotary jaw members pivot toward their latching positions: (1) the receiving formations close toward each other and embrace opposite sides of the striker to center the striker within the notches of the housing and to securely retain the striker within the confines of the side wall notches of the housing; (2) the secondary jaw member engages and compresses the resilient bumper to slow (if not stop) latching rotation of the jaws; and (3) if latching-direction rotation of the jaw members continues beyond a desired range of movement, the abutment formations on the jaw members engage to stop excessive jaw rotation. Thus the rotation of the opposed jaws is rapidly and yet smoothly arrested to prevent the jaws from rotating to an undesirable degree beyond their latched positions.

The bumper preferably takes the form of a trapezoidal shaped block of resilient material that is mounted on the housing by extending an elongate projecting portion of the bumper through a hole that is formed in the base wall of the housing. The bumper is positioned out of the path of rotation of the primary jaw so as to not hinder movement of the primary jaw to its release position. The bumper serves not only to cushion the operation of the latch but also cooperates with the spring that acts on the primary jaw to bias the jaw members toward their unlatched positions and to prevent vibratory rattling of the relatively movable parts of the latch.

In preferred practice, aligned pairs of holes are formed through the side walls of the housing to receive pins that journal the primary and secondary jaw members for rotation about spaced primary and secondary axes, respectively. Preferably the aligned notches that receive a striker as a closure is closed are formed in the side walls of the housing at locations that extend between the spaced primary and secondary axes.

In accordance with another feature of the preferred practice of the present invention, an operating lever for initiating unlatching of the latch is defined by a projection that extends from the primary jaw member. The operating lever can be manually actuated or can be coupled to a rod, a flexible cable, or to other linkage elements to effect its operation. By rotating the operating lever in a latching direction, the primary jaw member is rotated to a release position that is located slightly beyond its latched position, whereby the cooperative latching formations that are provided on the primary and secondary jaw members are caused to disengage, and the secondary jaw member is freed to execute unlatching rotation under the influence of the force of the resilient bumper that has been at least partially compressed by the secondary jaw member during movement of the jaws to their latched positions.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
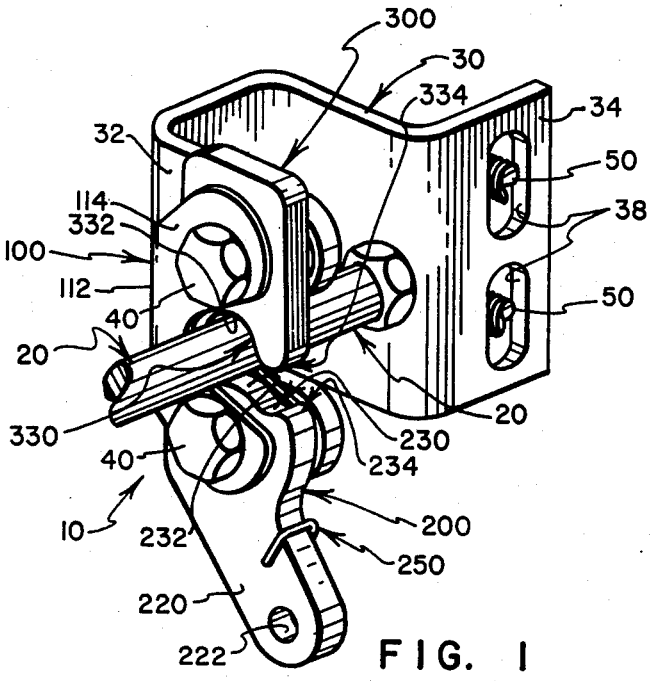
FIG. 1 is a perspective view of a rotary latch that embodies the preferred practice of the present invention, with the latch being supported by a mounting bracket of a preferred type, and with the view additionally depicting a portion of a striker that is shown latchingly engaged by opposed jaw members of the rotary latch.
Figure 2:
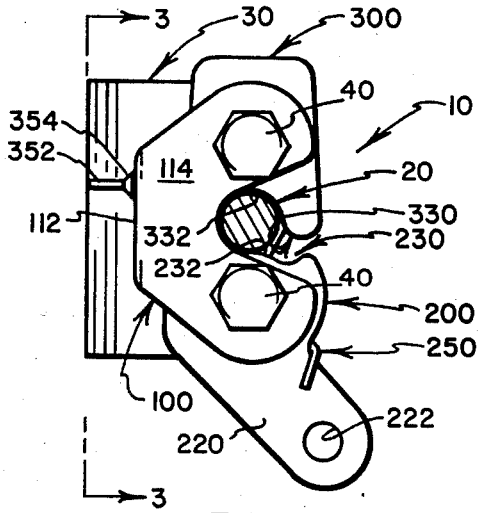
FIG. 2 is a side elevational view thereof.

Referring to FIG. 1, a rotary latch embodying the preferred practice of the present invention is indicated generally by the numeral 10. A striker that can be releasably retained by the latch 10 is indicated generally by the numeral 20. A bracket for mounting the latch 10 is indicated generally by the numeral 30. As will be explained in greater detail, relatively movable components of the latch 10 are shown in their latched positions in FIG. 1, with the striker 20 being latchingly engaged by the relatively movable components of the latch 10.

Figure 4:
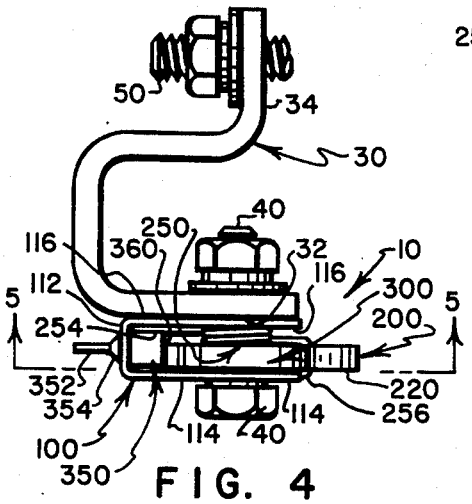
FIG. 4 is a top plan view thereof.
Figure 5:
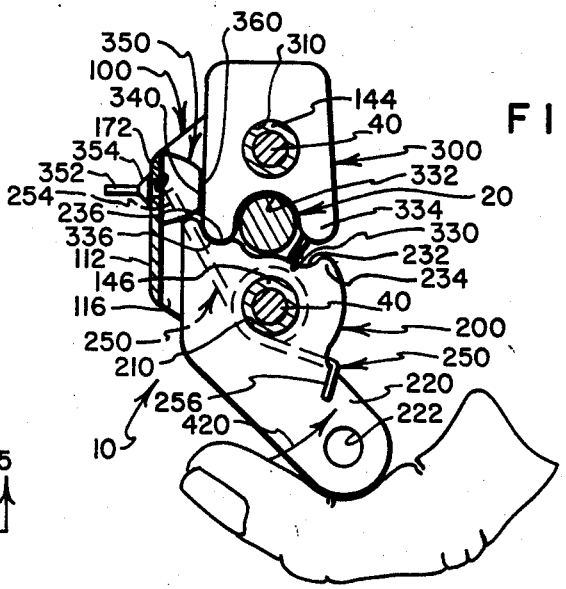
FIG. 5 is a sectional view as seen from a plane indicated by a line 5—5 in FIG. 4, with the rotary latch "latched" in retaining engagement with a striker, but with a fingertip being positioned for operating a primary one of the opposed jaws of the rotary latch to initiate unlatching of the latch.
Figure 12:
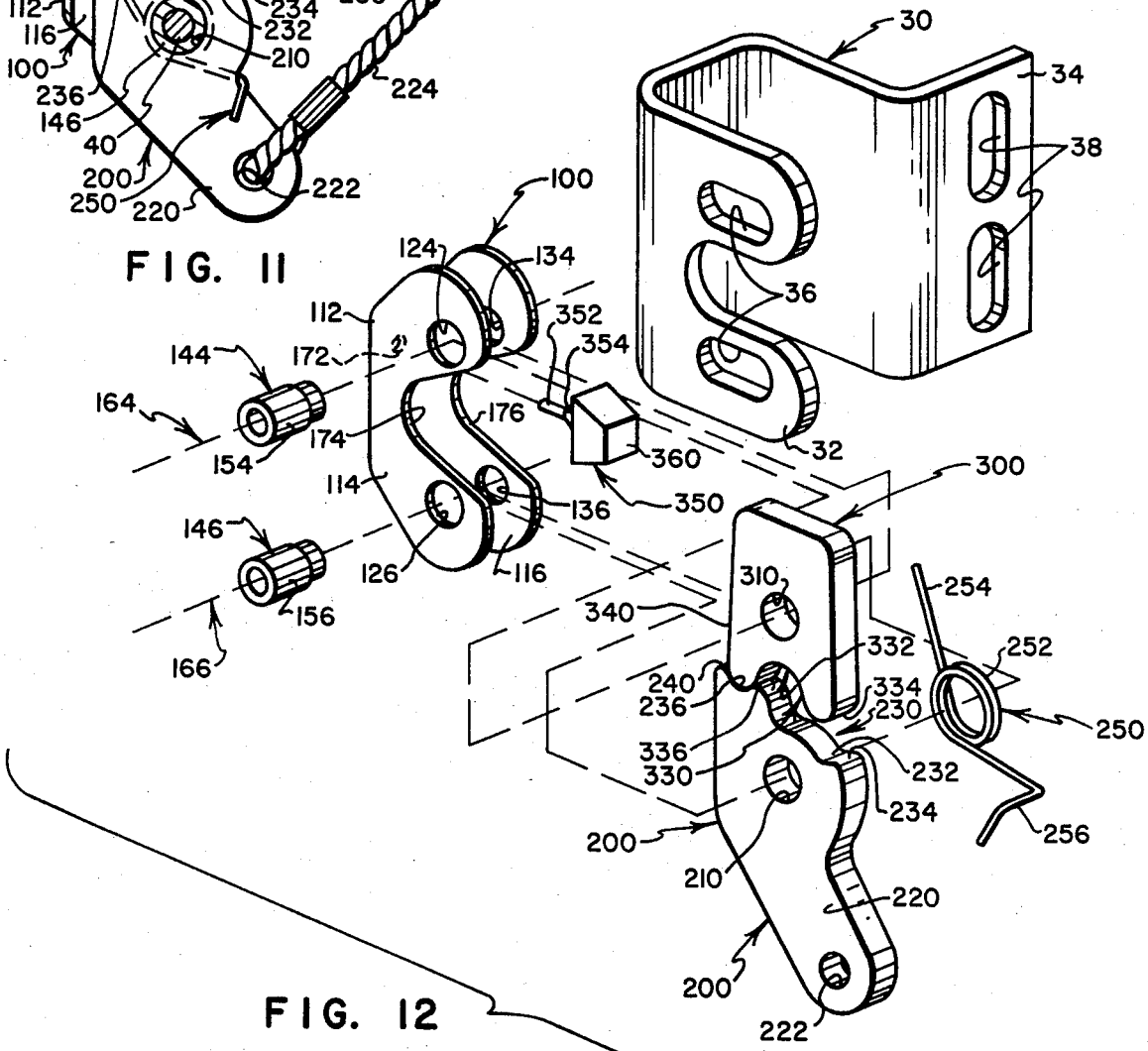

In brief overview, the latch 10 includes a housing 100 that protectively encloses and rotatably mounts a pair of opposed jaw members 200, 300. While the jaw members 200, 300 are equally essential to the proper performance of the latch 10, for simplicity of discussion the rotary jaw member 200 will be referred to as a "primary" jaw, while the rotary jaw member 300 will be referred to as a "secondary" jaw. Referring to FIGS. 4, 5 and 12, the latch 10 also includes a torsion coil spring 250 that is interposed between the housing 100 and the primary jaw 200, and a resilient bumper block 350 that is interposed between the housing 100 and the secondary jaw Typically the latch 10 is mounted on a door frame or other conventional structure (not shown) at a location that is near a door opening (not shown) which can be selectively opened and closed by a closure (not shown) that carries the striker 20. However, as will be apparent to those skilled in the art, the utility of latches that embody the spirit and practice of the present invention is not restricted to applications that involve the latching of closures such as doors, gates, access panels, hoods, lids and the like; rather, such latches can be utilized advantageously to establish releasable connections between or among a wide variety of relatively movable structures in applications where relatively light duty latching systems are appropriately employed.

A feature of latches that embody the preferred practice of the present invention is the ease with which they can be mounted on a door frame or other supporting structure. Referring to FIGS. 1–4, the latch 10 can be directly mounted as by a pair of conventional fasteners such as bolts 40 that extend through the housing 100 for connecting with a door frame (not shown). Alternatively, the latch 10 can be indirectly mounted as by utilizing the mounting bracket 30, with the bolts 40 serving to connect the latch 10 to the bracket 30, and with additional bolts 50 serving to connect the bracket 30 to a door frame or the like (not shown).

Figure 9:
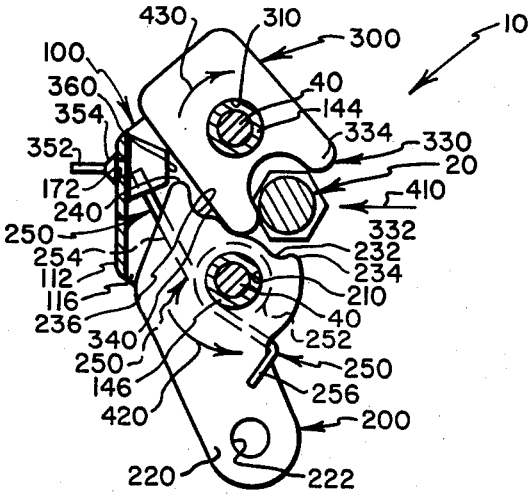
FIG. 9 is a sectional view similar to FIG. 8 but showing a striker moving into engagement with the opposed jaw of the rotary latch as latching is initiated.

The latch 10 operates to releasably engage the striker 20 as the striker 20 moves relatively toward the latch 10 along a path of travel that is indicated in FIG. 9 by an arrow 410. The striker 20 engages the secondary jaw 300, causing latching rotation of the secondary jaw 300 (as is indicated by an arrow 430), which, in turn, causes latching rotation of the primary jaw 200 (as is indicated by an arrow 420). As the primary and secondary jaws 200, 300 move toward their latched positions, the primary jaw 200 moves in opposition to the action of the torsion coil spring 250; likewise, the secondary jaw 300 is brought into engagement with the resilient bumper 350, causing the resilient material of the bumper block 350 to be compressed. Latching movement of the jaws 200, 300 in the directions of the arrows 430, 420 continues in opposition to the actions of the biasing devices 250, 350 as the biasing devices 250, 350 operate to damp and cushion the movements which comprise the latching action of the latch 10 (i.e., the movements of the striker 20 and of the jaws 200, 300 relative to the housing 100). This cushioning of the latching action as the jaws 200, 300 are moved to their latched positions causes the latching action to be characterized by a desirably smooth and firm "feel."

Figure 3:
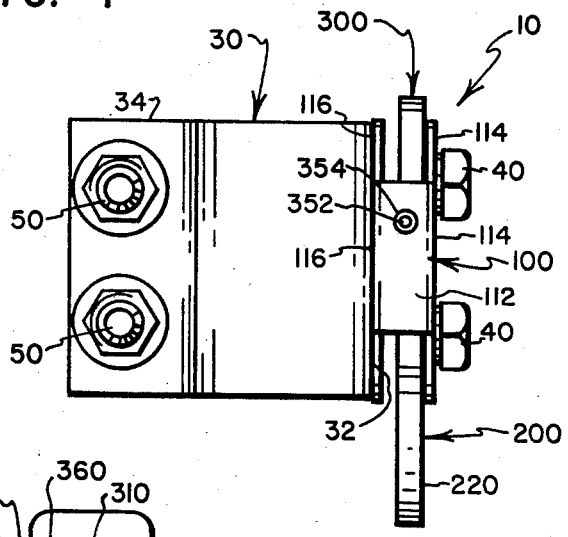
FIG. 3 is a rear elevational view as seen from a plane indicated by a line 3—3 in FIG. 2.

The latched positions of the jaw members 200, 300 are shown in FIGS. 1, 3 and 5. When the jaw members 200, 300 are "latched," (1) the striker 20 is embraced by recess formations 232, 332 that are provided on the jaws 200, 300; and, (2) a projecting portion 336 is provided on the secondary jaw member 300 is received within a mating recess 236 that is provided on the primary jaw member 200 to block rotation of the jaw members 200, 300 out of their latched positions, whereby the striker 20 is securely retained by the latch 10.

Figure 6:
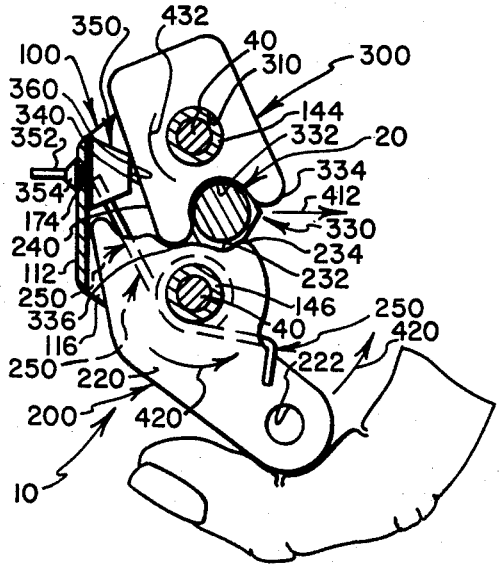
FIG. 6 is a sectional view similar to FIG. 5 but showing a primary one of the jaws moved to a release position to initiate the unlatching action of the latch.

The unlatching action of the latch 10 is depicted in a sequence of stages in the views that comprise FIGS. 5–8. Unlatching is initiated by rotating the primary jaw 200 in opposition to the action of the spring 250 in a direction of rotation that is indicated by an arrow 420 in FIG. 5, whereby the primary jaw 200 is moved from its latched position (as depicted in FIG. 5) to a release position (as depicted in FIG. 6). Once the primary jaw 200 reaches its release position, the primary jaw 200 no longer blocks unlatching movement of the secondary jaw 300, hence unlatching movement of the secondary jaw 300 is begun automatically under the influence of the force that is exerted on the secondary jaw by the compression of the material of resilient bumper 350. Unlatching movement of the secondary jaw 300 rotates the secondary jaw 300 in the direction of an arrow 432 shown in FIGS. 5 and 6 from the latched position depicted in FIG. 5 to an unlatched position which is depicted in FIG. 6.

Figure 7:
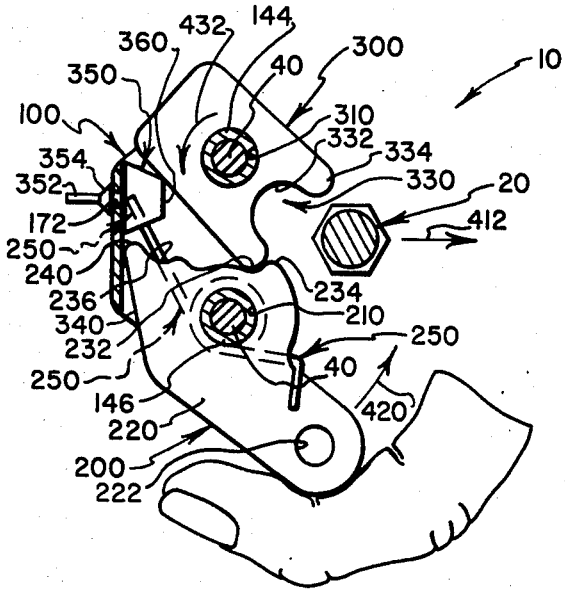
FIG. 7 is a sectional view similar to FIG. 6 but showing the unlatching action of the components of the rotary latch with the striker fully released by the jaws.
Figure 8:
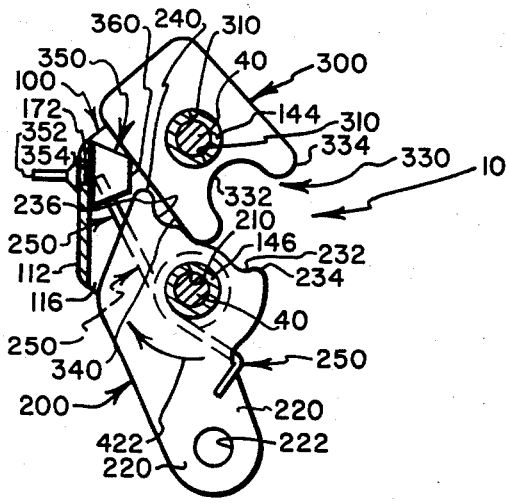
FIG. 8 is a sectional view similar to FIG. 7 but showing the components of the rotary latch in their unlatched positions.

Once the secondary jaw 300 has effected its unlatching movement, and once the primary jaw 200 is released from being held in its release position, the primary jaw 200 executes a counter-rotation in the direction of its unlatched position as by rotating under the influence of the torsion coil spring 250 in the direction of an arrow 422, as shown in FIG. 8. As the jaws 200, 300 move through the sequence of the unlatching action that is illustrated in FIGS. 5–8, the striker 20 is released for movement along a path of travel away from the latch 10, as is indicated by an arrow 412 in FIG. 7. The unlatched positions that are assumed by the jaws 200, 300 when the latch 10 is "unlatched" (and when neither of the jaws 200, 300 are being acted upon by outside forces) are depicted in FIG. 8.

Figure 11:
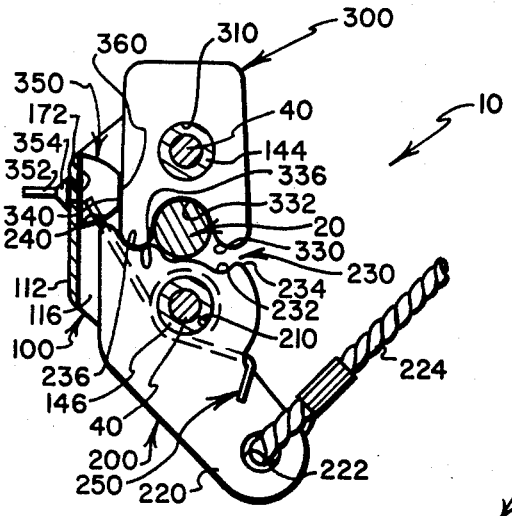
FIG. 11 is a sectional view similar to FIG. 9 but showing an arm portion of the primary jaw member coupled to an end region of a flexible cable for remote operation; and, FIG. 12 is an exploded perspective view showing in greater detail features of the rotary latch and the mounting bracket.

Turning now to a more detailed description of the latch 10, its components and its operation, and referring particularly to FIGS. 3 and 4, the housing 100 is of generally U-shaped configuration, having a base wall 112 that interconnects a pair of spaced, parallel-extending side walls 114, 116. As is best seen in FIG. 12, aligned pairs of holes 124, 134 and 126, 136 are formed through the side walls 114, 116, respectively to receive hollow pins 144, 146 that are riveted into place to interconnect the side walls 114, 116. The pins 144, 146 have cylindrical outer surface portions 154, 156 that extend through holes 210, 310 that are formed in the jaws 200, 300 to rotatably mount the jaws 200, 300 on the housing 100. The pins 144, 146 define axes (indicated by numerals 164, 166 in FIG. 12) about which the jaws 300, 200 rotate relative to the housing 100. The axes 164, 166 extend in spaced, parallel relationship, and are substantially perpendicular to the planes of the parallel side walls 114, 116 of the housing 100. The bolts 40 are inserted through the hollow pins 144, 146 and extend along the axes 164, 166 to mount the latch 10, as has been described Other features of the housing 100 include a pair of aligned, forwardly-facing notches 174, 176 that are formed in front edge portions of the side walls 114, 116, respectively, and a hole 172 that is formed through the base wall 112. The notches 174, 176 extend between the axes 164, 166 for permitting the striker 20 to pass between the axes 164, 166 in moving between latched and unlatched positions (shown in FIGS. 2 and 9, respectively). As is best seen in FIGS. 11 and 12, the hole 172 is formed through the base wall 112 and serves to receive a mounting portion 352 of the resilient bumper block 350, as will be explained.

Referring to FIG. 12, the primary jaw member 200 is formed as a metal stamping having a mounting hole 210 that is sized to smoothly journal the cylindrical mounting surface 156 of the pin 146, whereby the primary jaw member 200 is rotatably connected to the housing 100. An elongate operating arm formation 220 depends from the vicinity of the mounting hole 210 to provide a lever-like handle that can be engaged by a fingertip (as is shown in FIGS. 5–7) to move the primary jaw member 200 from its latched position to its release position (as shown in FIGS. 5 and 6, respectively). A connecting hole 222 is provided through the arm formation 220 to enable a suitable operating linkage, operating rod, or the like to connect with the arm formation 220 for remotely operating the primary jaw member 200 to initiate unlatching of the latch 10. Referring to FIG. 11, a flexible cable 224 is shown connected to the arm formation 220 by means of an end region of the cable 224 being inserted through the hole 222

The primary jaw member 200 has an upper surface 230 that is relatively complexly configured in that it incorporates a plurality of formations that are designed to cooperate with corresponding formations which are provided on the secondary jaw member 300, as will be described. At the rearward edge of the surface 230, a rounded stop formation 240 is provided for engaging the base wall 112 of the housing 100 when the primary jaw 200 has been rotated to its release position, as is shown in FIGS. 5 and 6.

Referring to FIG. 12, the secondary jaw member 300 is formed as a metal stamping having a mounting hole 310 that is sized to smoothly journal the cylindrical mounting surface 154 of the pin 144, whereby the secondary jaw member 300 is rotatably connected to the housing 100. The secondary jaw member 300 has an upper surface 330 that is relatively complexly configured in that it incorporates a plurality of formations that are designed to cooperate with corresponding formations which are provided on the primary jaw member 200, as will be described. An abutment surface 340 is provided on one side of the secondary jaw 300 for engaging the resilient bumper block 350 when the secondary jaw 300 is in its latched position, as is depicted in FIG. 11.

Figure 10:
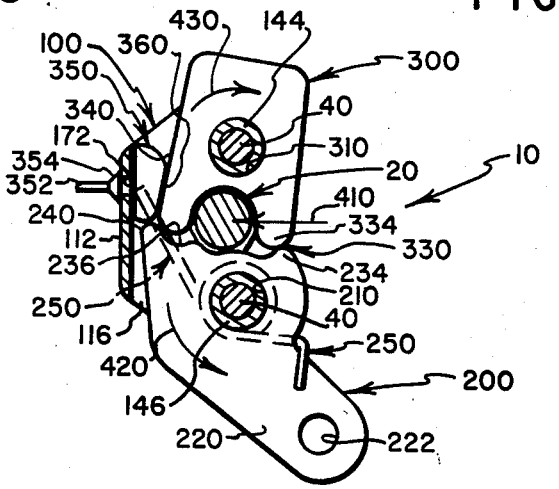
FIG. 10 is a sectional view similar to FIG. 5 but showing a condition of "overtravel" of the opposed jaws that can occur as the rotary latch arrests relative movement of the striker at the conclusion of a latching action.

Referring to FIG. 12, the cooperatively configured surfaces 230, 330 of the jaws 200, 300, respectively, include receiving formations 232, 332 that are of generally concave configuration for receiving, embracing and retaining opposed side portions of the strike 20. The concave receiving formations 232, 332 are joined at their forward ends by convex stop formations 234, 334 that are arranged to engage each other in the extreme situation where the striker 20 has been so forcefully slammed into engagement with the latch 10 that "overtravel" positions are assumed by the jaws 200, 300, as depicted in FIG. 10. A pair of interengageable latching formations 236, 336 are provided on the jaws 200, 300, respectively, near the rearward ends of the receiving formations 232, 332. The formation 236 is a concave recess that is provided on the primary jaw 200 near the stop projection 240 to receive the formation 336, which takes the form of a convex projection that extends from the secondary jaw 300. When the formations 236, 336 matingly engage, they function to retain the jaws 200, 300 in their latched positions, as shown in FIG. 5. However, when the primary jaw 200 is rotated to its release position, as shown in FIG. 6, the formations 236, 336 disengage to permit unlatching movement first of the secondary jaw 300 (as shown in FIG. 7) and then of the primary jaw 200 (as shown in FIG. 8).

The torsion coil spring 250 has a central coil 252 that extends loosely about the pin 146, with an end region 254 that engages the base wall 112 of the housing 100, and with an end region 256 that engages the depending arm formation 220 of the primary jaw 200. The spring 250 serves to bias the primary jaw 200 toward its unlatched position, i.e., in the direction of the arrow 422 shown in FIG. 8.

The resilient bumper block 350 has an elongate mounting projection 352 that extends through the mounting hole 172 that is formed through the base wall 112 of the housing 100. An enlargement 354 is formed on the projection 352 at a location that causes the enlargement 354 to be positioned adjacent the rearward end of the hole 172 to prevent retraction of the projection 352 into the hole 172, and to thereby retain the block 350 in position on the housing 100 at a location adjacent the forward end of the hole 172.

The bumper block 350 is of generally trapezoidal shape, having a forwardly-facing surface 360 of relatively narrow length that is positioned to engage the abutment surface 340 of the secondary jaw 300 when the secondary jaw 300 is positioned as shown in FIGS. 5, 10 and 11. The material of the resilient bumper block 350 is selected to provide a relatively firm but compressible cushion that is engaged by the secondary jaw 300 as the secondary jaw 300 moves to its latched position. The abutment surface 340 engages the forward face 360 of the bumper block 350 such that the material of the bumper block 350 is compressed, whereby the latching action of the latch 10 is caused to be cushioned by the bumper block 350. Moreover, because the secondary jaw 300 holds the material of the bumper block 350 in compression during the time that the secondary jaw 300 is in its latched position, the compressed bumper block 350 applies a force to the secondary jaw 300 (i.e., while the latch 10 is latched) that cooperates with the action of the torsion coil spring 250 on the primary jaw 200 to minimize rattling of the relatively movable parts of the latch 10 under the influence of vibration, and that initiates rotary movement of the secondary jaw 300 toward its unlatched position when the primary jaw 200 is moved to its release position.

Referring to FIGS. 1–4 and 12, the mounting bracket 30 provides a preferred means for mounting the latch 10 inasmuch as it defines a pair of mounting surfaces 32, 34 that extend in substantially perpendicular planes, with adjustment slots 36, 38 being provided in each of the surfaces 32, 34 for receiving the bolts 40, 50, respectively, whereby the configuration and the adjustable character of the bracket 30 enables the latch 10 to be adjustably positioned as may be needed to accommodate the path of travel that is followed by the striker 20 in moving relative to the latch 10.

Latching of the striker 20 with the latch 10 is initiated, as is shown in FIG. 9, by moving the striker 20 along a path of travel that is designated by the arrow 410 such that the striker 20 is caused to engage and rotate the secondary jaw 300 in a latching direction of rotation that is designated by an arrow 430. Rotation of the secondary jaw 300 in the direction of the arrow 430 causes the primary jaw 200 to rotate in the direction of the arrow 420, with rotation of the jaws 200, 300 continuing until the jaws 200, 300 are at a position where the convex latching formation 336 of the secondary jaw 300 "rides out of" the concave receiving formation 232 of the primary jaw 200 and into the concave latching formation 236 of the primary jaw 200, whereupon the primary jaw 200 executes a minute degree of counter-rotation under the influence of the spring 250 to bring the jaws 200, 300 to the latched position of FIGS. 1, 2, 3, 5 and 11. As the jaws 200, 300 approach their latched positions, the biasing actions of the spring 250 and the resilient bumper 350 serve to cushion the latching action so that, in most cases of normal operation, no excessive "overtravel" of the jaws in rotating beyond their latched positions is encountered. However, if overtravel does occur, the jaws 200, 300 have abutments 236, 336 that engage each other to arrest the movement of the jaws 200, 300.

In order to unlatch the latch 10, the operating arm formation 220 of the primary jaw 200 is pivoted from the latched position shown in FIG. 5 to the release position shown in FIG. 6, whereupon the secondary jaw 300 is moved by the force of the compressed bumper block 350 acting thereon to execute an unlatching movement in the direction of the arrow 432 in FIG. 6. Once the force that has moved the primary jaw 200 to the release position of FIG. 6 is withdrawn, the primary jaw 200 likewise moves to execute an unlatching movement under the influence of the spring 250, as is indicated by the arrow 422 in FIG. 8.

A significant feature of a latch that embodies the preferred practice of the present invention resides in the cooperatively interactive roles played by the jaws 200, 300 in receiving, embracing and releasably retaining the striker 20, with the complexly configured surfaces 230, 330 providing striker-receiving formations 232, 332, overtravel stop formations 234, 334, and interengageable latch formations 236, 336 that serve to coordinate the latching, release and unlatching movements of the jaws 200, 300.

Another feature resides in the characteristic kinds of cooperative movements that are executed by the pair of rotary jaws 200, 300 to effect latching and unlatching of the latch 10. The movements executed by the jaws 200, 300 are subtle in the way in which they are properly orchestrated to achieve the described types of latching and unlatching actions with the described minimum number of operating components using the described minimum number of simply configured parts. In this regard, those skilled in the art will recognize that:

I. Both during latching and unlatching of the latch 10, the kind of movement that is executed by the primary jaw member 200 is bi-directional in character, meaning that:

A. During latching, the primary jaw 200 rotates in a first direction away from the unlatched position to receive and embrace the striker 20; but, B. To complete its latching movement, the primary jaw 200 moves in an second (opposite) direction toward the unlatched position as the latch formation 336 of the secondary jaw 300 rides out of the receiving formation 232 of the primary jaw 200, which is to say that the primary jaw 200 completes its latching movement by counter-rotating toward its unlatched position to bring its concave latch formation 236 into receiving engagement with the convex latch projection 336 of the secondary jaw 300;

C. During unlatching, the primary jaw 200 rotates in a first direction away from the latched and unlatched positions to permit the latch formation 336 of the secondary jaw 300 to ride into the concave receiving formation 232 of the primary jaw 200 so that movement of the jaws 200, 300 that is blocked by the seated engagement of the latch formation 336 within the latch formation 236 is released; and, D. Unlatching movement of the primary jaw member 200 is completed by counter-rotation of the primary jaw member 200 toward the unlatched position under the influence of the spring 250;

II. Both during latching and unlatching of the latch 10, the kind of movement that is executed by the secondary jaw member 300 is of a uni-directional character, meaning that:

A. During latching, the secondary jaw member 300 rotates in a single direction away from its unlatched position (it reverses direction only if a condition of "overtravel" occurs whereby the secondary jaw is caused to overshoot its latched position); and, B. During unlatching, the secondary jaw member 300 does nothing more than to rotate in from its latched to its unlatched position;

III. During latching movements of the jaws 200, 300 (i.e., as the striker 20 moves along its path of travel rearwardly into the notches 174, 176), the secondary jaw 300 pushes the primary jaw 200 to effect *concurrent rotation in unison* of the jaws 200, 300 in directions away from the unlatched position (i.e., the jaws 200, 300 cooperate in the sense that they move concurrently, in unison during latching); and, IV. During unlatching movements of the jaws 200, 300, the jaws 200, 300 move *cooperatively* but *independently* of each other, with the primary jaw 200 being the first to move (to its release position so as to permit the secondary jaw 300 to move out of its latched position toward its unlatched position), whereupon the secondary jaw 300 moves independently of the primary jaw 200 to its unlatched position, and the primary jaw 200 moves only when it is physically released (by relieving the operating force that has brought it to its release position) to its unlatched position under the influence of the spring 250.

A further feature of latches that embody the preferred practice of the present invention resides in the capability of such latches to work with very simply configured strikers. Substantially any form of striker that offers a short length of cylindrical engagement surface (typically of a diameter of about ⅜ inch) can be used with these latches.

Still another feature of the preferred practice of the invention resides in the manner in which the resilient bumper 350 is releasably installed on the housing 100 Installing the bumper 350 is a simple matter of inserting the distal end region of the projection 352 through the hole 172 and grasping the projection 352 to draw the enlargement 354 through the hole 172, whereby the bumper 350 is retained in place on the housing 100. If, however, the bumper 350 needs to be replaced due to wear, or if the bumper 350 is to be replaced with a bumper formed from firmer or softer material to accommodate the needs of a particular latch application, the bumper block 350 is grasped by a pair of pliers and pulled out of its mounted position, as by causing the enlargement 354 and the remainder of the projection 352 to be withdrawn back through the hole 172.

Although the invention has been described in its preferred from with a certain degree of particularity, it is understood that the present disclosure of the preferred form has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A rotary latch for receiving a striker that is movable relative to the latch along a path of travel, and for releasably engaging the striker to selectively arrest relative movement between the striker and the latch, the latch comprising:

(a) housing means having structure that extends in opposed forward and rearward directions along a path of travel that is followed by a striker, and that defines a generally U-shaped notch which opens through a forward part of the housing for receiving a striker as the striker moves rearwardly along the path of travel into the notch;

(b) first and second rotary jaw means movably connected to the housing means for rotation about spaced first and second axes located on opposite sides of the U-shaped notch, with the first and second rotary jaw means defining first and second portions, respectively, that extend along the path of travel and provide formation (i) for extending into the notch for receiving the striker as the striker moves along said path of travel into the notch;

(ii) for interacting with the striker so as to move rearwardly therewith in response to movement of the striker rearwardly into the notch, with such interaction causing rotary movement of the first and second rotary jaw means about said first and second axes from an unlatched position, wherein the striker is free to move into and out of the notch, to a latched position, wherein said portions embrace and retain the striker to confine the striker from exiting the notch as by moving forwardly along the path of travel; and, (iii) for interengaging during movement from the unlatched position to the latched position so as to block counter-rotation of the first and second rotary jaw means about the first and second axes that would effect return of said portions to the unlatched position until the first rotary jaw means is rotated about the first axis to a release position to release said interengagement, whereby the other of said first and second rotary jaw means is permitted to initiate counter-rotation toward the unlatched position;

(c) first biasing means interposed between the first rotary jaw means and the housing means for biasing the first rotary jaw means in a direction of rotation about the first axis that urges the first portion to move along the path of travel in a direction that extends generally forwardly with respect to the notch; and, (d) second biasing means interposed between the second rotary jaw means and the housing means for engaging the second rotary jaw means when the second rotary jaw means is rotated about the second axis to a contacting position that is intermediate the unlatched and the latched positions, and for continuing to engage the second rotary jaw means until the second rotary jaw means is rotated about the second axis to a rotary position that is between the contacting position and the unlatched position, with the second biasing means serving to bias the second rotary jaw means in a direction about the second axis that urges the second portion to move along the path of travel in a direction that extends generally forwardly with respect to the notch, and with the biasing force that is applied to the second rotary jaw means by the second biasing means during such contact being characterized by a magnitude that increases as the rotary position of the second rotary jaw means moves away from the contacting position in a direction that causes the second portion to move along the path of travel in a direction that extends generally rearwardly with respect to the notch, whereby the second biasing means serves to cushion the latching action of the second rotary jaw means to an increasing degree as the striker moves rearwardly into the notch.

2. The rotary latch of claim 1 wherein the formation means include recess formations of a generally concave configuration that close toward the striker as the striker is moved rearwardly along the path of travel into the notch and as the first and second rotary jaw means move concurrently toward the latched position, whereby the recess formations serve to center the striker with respect to opposite sides of the notch, and whereby, when the first and second rotary jaw means are in the latched position, the first and second rotary jaw means function to hold the striker at a predetermined centered location out of engagement with such portions of the housing means as define the notch.

3. The rotary latch of claim 1 wherein the second biasing means includes a block of resilient material that is interposed between the second portion and the housing means.

4. The rotary latch of claim 3 wherein the housing means has a mounting hole formed therethrough, the block of resilient material has an integrally formed, elongate mounting projection, and the block of resilient material is connected to the housing means by extending the mounting projection through the mounting hole.

5. The rotary latch of claim 3 wherein the block of resilient material is of generally trapezoidal shape having spaced, substantially parallel-extending forward and rearward surfaces positioned to engage the second portion and the housing means, respectively, and having at least one side surface that is inclined with respect to the forward and rearward surfaces and that extends to one side of a path of movement that is followed by the first rotary jaw means as the first rotary jaw means pivots about the first axis relative to the housing means, with the block of resilient material being connected to the housing and being positioned rearwardly with respect to the notch at a location along the path of travel of the striker, but with the block of resilient material serving to engage only the second of the first and second rotary jaw means.

6. The rotary latch of claim 1 wherein:

(a) the housing means includes a one-piece housing of generally U-shaped configuration having a base wall and a pair of side walls that are rigidly interconnected by the base wall, with the side walls having substantially planar side wall portions that extend in spaced, substantially parallel relationship along opposite sides of the path of travel, and with the base and side walls cooperating to define a chamber that is located between the side walls and that is bordered on three sides by the base and side walls;

(b) first and second pairs of aligned holes are formed through the side walls, with the aligned holes of the first pair extending along the first axis, with the aligned holes of the second pair extending along the second axis, and with the first and second axes extending in spaced, parallel relationship through the chamber in directions that are substantially perpendicular to the planar side wall portions;

(c) first and second pin means extend, respectively, along the first and second axes and have end regions that are received, respectively, by the aligned holes of the first and second pairs, for defining first and second cylindrical mounting surfaces at spaced locations within the chamber;

(d) the first and second rotary jaw means have first and second holes formed therethrough, respectively,. with the first hole journaling the first mounting surface to rotatably connect the first rotary jaw means to the housing, and with the second hole journaling the second mounting surface to rotatably connect the second rotary jaw means to the housing.

7. The rotary latch of claim 6 wherein the first and second pin means include first and second hollow pin means define a pair of holes extending therethrough along the first and second axes, and additionally including mounting means for connecting the housing to a supporting structure, the mounting means including a pair of elongate fastener means for extending through the pair of holes.

8. The rotary latch of claim 7 wherein the mounting means additionally includes bracket means for defining a pair of spaced mounting surface portions that extend in planes that are oriented substantially perpendicular to each other, with each of the mounting surface portions having a set of holes formed therethrough, and with the fastener means extending through a selected one of the set of holes to connect the housing to the bracket.

9. The rotary latch of claim 6 additionally including stop formation means provided on the first rotary jaw means for engaging the base wall of the housing when the first rotary jaw means is rotated to its release position.

10. The rotary latch of claim 1 wherein the first rotary jaw means has an arm portion formed integrally therewith that projects from the chamber to form an arm that can be rotated to rotate the first rotary jaw means about the first axis from the latched position to the release position.

11. The rotary latch of claim 10 wherein the arm defines a connecting formation means for connecting the arm to a remote operating link to enable the arm to be rotated about the first axis to rotate the jaw means from the latched position to the release position.

12. The rotary latch of claim 10 wherein the first biasing means includes a torsion coil spring that is interposed between the operating arm portion and the housing to bias the first rotary jaw means and its associated rotary jaw means toward its unlatched position.

13. The rotary latch of claim 1 wherein the formation means include a pair of stop formations that are brought into abutting engagement with each other to arrest rotation of the first and second rotary jaw means if movement of the striker along the path of travel is not arrested by the time that the striker has effected movement of the first and second rotary jaw means to the latched positions, whereby the degree to which rotation of the first and second rotary jaw means is permitted beyond the latched position is limited by the stop formations.

14. The rotary latch of claim 1 wherein the formation means also function to permit coordinated but independent movements of the first and second rotary jaw means once the first and second rotary jaw means have reached the latched position, whereby the first rotary jaw means can be moved from its latched position to its release position, whereupon the second rotary jaw means can be moved from its latched position to its unlatched position, and whereupon the first rotary jaw means also can be moved from its latched position to its unlatched position.

15. A rotary latch for receiving a striker that is movable relative to the latch along a path of travel, and for releasably engaging the striker to selectively arrest relative movement between the striker and the latch, the latch comprising:

(a) housing means having structure that extends in opposed forward and rearward directions along a path of travel that is followed by a striker, and that defines a generally U-shaped notch which opens through a forward part of the housing for receiving a striker as the striker moves rearwardly along the path of travel into the notch;

(b) first and second rotary jaw means movably connected to the housing means for rotation about spaced first and second axes located on opposite sides of the U-shaped notch, with the first and second rotary jaw means having cooperative formation means thereon for:

(i) receiving a striker therebetween as a striker moves toward the latch along the path of travel, with the striker being permitted to pass freely into and out of a space that is defined between the cooperative formation means when the first and second rotary jaw means are both in their unlatched positions, but with the striker being embraced and retained by the cooperative formation means when the first and second rotary jaw means have moved in unison from their unlatched positions to their latched positions as the result of being engaged by the striker as the striker has moved along said path of travel;

(ii) establishing a latching engagement once the first and second rotary jaw means have reached their latched positions, with portions of the cooperative formation means of each of the first and second rotary jaw means engaging to block unlatching rotation of the first and second jaw means;

(iii) providing a pair of stop formations that are brought into abutting engagement with each other to arrest rotation of the first and second rotary jaw means if movement of the striker along said path of travel is not arrested by the time that the striker has effected movement of the first and second rotary jaw means to their latched positions, whereby the degree to which rotation of the first and second rotary jaw means beyond their latched position is limited by the stop formations; and, (iv) permitting coordinated but independent movements of the first and second rotary jaw means once the first and second rotary jaw means have reached their latched position, whereby the first rotary jaw means can be moved from its latched position to its release position, whereupon the second rotary jaw means can be moved from its latched to its unlatched position, and whereupon the first rotary jaw means also can be moved from its latched to its unlatched position;

(c) first biasing means interposed between the first rotary jaw means and the housing means for biasing the first rotary jaw means in a direction of rotation about the first axis that urges the first portion to move along the path of travel in a direction that extends generally forwardly with respect to the notch; and, (d) second biasing means interposed between the second rotary jaw means and the housing means for engaging the second rotary jaw means when the second rotary jaw means is rotated about the second axis to a contacting position that is intermediate the unlatched and the latched positions, and for continuing to engage the second rotary jaw means until the second rotary jaw means is rotated about the second axis to a rotary position that is between the contacting position and the unlatched position, with the second biasing means serving to bias the second rotary jaw means in a direction about the second axis that urges the second portion to move along the path of travel in a direction that extends generally forwardly with respect to the notch, and with the biasing force that is applied to the second rotary jaw means by the second biasing means during such contact being characterized by a magnitude that increases as the rotary position of the second rotary jaw means moves away from the contacting position in a direction that causes the second portion to move along the path of travel in a direction that extends generally rearwardly with respect to the notch, whereby the second biasing means serves to cushion the latching action of the second rotary jaw means to an increasing degree as the striker moves rearwardly into the notch.

16. The rotary latch of claim 15 wherein the formation means include recess formations of a generally concave configuration that close toward the striker as the striker is moved rearwardly along the path of travel into the notch and as the first and second rotary jaw means move concurrently toward the latched position, whereby the recess formations serve to center the striker with respect to opposite sides of the notch, and whereby, when the first and second rotary jaw means are in the latched position, the first and second rotary jaw means function to hold the striker at a predetermined centered location out of engagement with such portions of the housing means as define the notch.

17. The rotary latch of claim 15 wherein the second biasing means includes a block of resilient material that is interposed between the second portion and the housing means.

18. The rotary latch of claim 17 wherein the housing means has a mounting hole formed therethrough, the block of resilient material has an integrally formed, elongate mounting projection, and the block of resilient material is connected to the housing means by extending the mounting projection through the mounting hole.

19. The rotary latch of claim 17 wherein the block of resilient material is of generally trapezoidal shape having spaced, substantially parallel-extending forward and rearward surfaces positioned to engage the second portion and the housing means, respectively, and having at least one side surface that is inclined with respect to the forward and rearward surfaces and that extends to one side of a path of movement that is followed by the first rotary jaw means as the first rotary jaw means pivots about the first axis relative to the housing means, with the block of resilient material being connected to the housing and being positioned rearwardly with respect to the notch at a location along the path of travel of the striker, but with the block of resilient material serving to engage only the second of the first and second rotary jaw means.

20. The rotary latch of claim 15 wherein:

(a) the housing means includes a one-piece housing of generally U-shaped configuration having a base wall and a pair of side walls that are rigidly interconnected by the base wall, with the side walls having substantially planar side wall portions that extend in spaced, substantially parallel relationship along opposite sides of the path of travel, and with the base and side walls cooperating to define a chamber that is located between the side walls and that is bordered on three sides by the base and side walls;

(b) first and second pairs of aligned holes are formed through the side walls, with the aligned holes of the first pair extending along the first axis, with the aligned holes of the second pair extending along the second axis, and with the first and second axes extending in spaced, parallel relationship through the chamber in directions that are substantially perpendicular to the planar side wall portions;

(c) first and second pin means extend, respectively, along the first and second axes and have end regions that are received, respectively, by the aligned holes of the first and second pairs, for defining first and second cylindrical mounting surfaces at spaced locations within the chamber;

(d) the first and second rotary jaw means have first and second holes formed therethrough, respectively, with the first hole journaling the first mounting surface to rotatably connect the first rotary jaw means to the housing, and with the second hole journaling the second mounting surface to rotatably connect the second rotary jaw means to the housing.

21. The rotary latch of claim 20 wherein the first and second pin means include first and second hollow pin means define a pair of holes extending therethrough along the first and second axes, and additionally including mounting means for connecting the housing to a supporting structure, the mounting means including a pair of elongate fastener means for extending through the pair of holes.

22. The rotary latch of claim 21 wherein the mounting means additionally includes bracket means for defining a pair of spaced mounting surface portions that extend in planes that are oriented substantially perpendicular to each other, with each of the mounting surface portions having a set of holes formed therethrough, and with the fastener means extending through a selected one of the set of holes to connect the housing to the bracket.

23. The rotary latch of claim 20 additionally including stop formation means provided on the first rotary jaw means for engaging the base wall of the housing when the first rotary jaw means is rotated to its release position.

24. The rotary latch of claim 15 wherein the first rotary jaw means has an arm portion formed integrally therewith that projects from the chamber to form an arm that can be rotated to rotate the first rotary jaw means about the first axis from the latched position to the release position.

25. The rotary latch of claim 24 wherein the arm defines a connecting formation means for connecting the arm to a remote operating link to enable the arm to be rotated about the first axis to rotate the jaw means from the latched position to the release position.

26. The rotary latch of claim 24 wherein the first biasing means includes a torsion coil spring that is interposed between the operating arm portion and the housing to bias the first rotary jaw means and its associated rotary jaw means toward its unlatched position.

* * * * *